US011540587B2

(12) United States Patent
Castillo

(10) Patent No.: US 11,540,587 B2
(45) Date of Patent: Jan. 3, 2023

(54) VISOR WITH MULTI-POSITION LOCKING SYSTEM

(71) Applicant: Troy Lee Designs LLC, Corona, CA (US)

(72) Inventor: Daniel J. Castillo, Laguna Beach, CA (US)

(73) Assignee: Troy Lee Designs LLC, Corona, CA (US)

( * ) Notice: Subject to any disclaimer, the term of this patent is extended or adjusted under 35 U.S.C. 154(b) by 37 days.

(21) Appl. No.: 17/039,318

(22) Filed: Sep. 30, 2020

(65) Prior Publication Data

US 2022/0095735 A1 Mar. 31, 2022

(51) Int. Cl.
*A42B 3/22* (2006.01)

(52) U.S. Cl.
CPC ..... *A42B 3/223* (2013.01); *A42B 3/227* (2013.01)

(58) Field of Classification Search
CPC ..... A42B 3/223; A42B 3/227
See application file for complete search history.

(56) References Cited

U.S. PATENT DOCUMENTS

2011/0154551 A1 6/2011 Spink
2014/0189939 A1 7/2014 Cheng
2015/0250249 A1 9/2015 Jacobsen
2017/0273385 A1 9/2017 Scheller
2018/0279709 A1* 10/2018 Durham ..... A42B 3/04
2020/0037692 A1* 2/2020 Levesque ..... A42B 3/227

FOREIGN PATENT DOCUMENTS

DE 102006020134 B3 2/2008

OTHER PUBLICATIONS

International Search Report and Written Opinion in PCT/US2021/052549, dated Feb. 15, 2022, 9 pages.

* cited by examiner

*Primary Examiner* — Katherine M Moran
*Assistant Examiner* — Erick I Lopez
(74) *Attorney, Agent, or Firm* — Lewis Rice LLC

(57) ABSTRACT

A multi-positional helmet visor system in which the visor can be repositioned to a plurality of positions. Cooperating structures in the visor and helmet inhibit the unwanted changes in visor position. The helmet uses a magnetic source disposed on a boss in a sliding element of the visor, which cooperates and mates with a series of ferromagnetic elements disposed in detents along the medial front to assist in holding the visor in place. The magnetic force and boss-detent structures inhibit unwanted movement the visor. The visor may be inhibited from being lowered into the cyclist's field of view by sets of cooperating stops on the visor and helmet.

19 Claims, 4 Drawing Sheets

VISOR WITH MULTI-POSITION LOCKING SYSTEM

BACKGROUND OF THE INVENTION

Field of the Invention

This disclosure is related to the field of bicycle safety equipment and, more particularly, to a helmet and visor system in which the visor is movable to a plurality of locations on the helmet.

Description of the Related Art

Bicycles are used around the world for transport, recreation, exercise, and competitive purposes. The small profile and lightweight construction of a bicycle make it an ideal mode of transportation for crowded urban areas, and bicycling is widely regarded as having a number of advantages over motorized transportation, including increased exercise for the cyclist, reduced consumption of fossil fuels, reduced pollution, and reduced traffic congestion. As such, bicyclists are increasingly sharing road space with conventional motorized vehicles, and safety equipment is of prime importance.

An important piece of safety equipment for any bicyclist is the helmet. Most bicycle helmets are constructed in a multi-layered structure to reduce the rate of deceleration of the cyclist's head in the event of an accident. This in turn reduces the likelihood (and severity) of brain injury. Helmets are designed with multiple purposes in mind, some of which are at odds with one another. On one hand, the helmet must be sufficiently rigid to absorb impacts. On the other hand, the construction should not directly transfer the full force of an impact to the cyclist's head. Additionally, the cyclist produces additional body heat from physical exertion, which can become trapped by the helmet shell and inhibit sweat evaporation. Accordingly, the helmet should also facilitate airflow for cooling.

Further, although it is desirable for the helmet to cover as much of the head as possible, helmet construction should not inhibit the cyclist's field of vision, including direct and peripheral, and the helmet should not interfere with the use of other equipment used by cyclists for convenience and/or safety, such as sunglasses or goggles.

There have been many attempts over the years to satisfy all of these competing needs, such as by adding a visor to the helmet. Prior attempts to meet these competing purposes have been insufficient. Such attempts include the use of removable visors. However, during a ride, the cyclist then must stop to safely remove and stow the visor. Attempts at multi-positional visors have also been lacking, resulting in solutions in which the visor can be easily dislodged from a given setting by the ordinary motion and impacts of a bicycle operating over the terrain.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a helmet comprising: an outer shell defining an inner volume adapted to fit a human head, the outer shell comprising in one preferred embodiment: an outer surface; a plurality of detents disposed long the outer surface at a front side thereof; each detent in the plurality of detents having a magnetic element disposed at a base thereof; a visor rotatably attached to the outer shell and comprising: a shading element; a sliding element comprising: a cross-section having a surface contour corresponding to a surface contour of the outer surface at the plurality of detents; a boss disposed on an inner surface of the sliding element, the boss having a recess; a visor magnetic element disposed in the recess; wherein the plurality of detents are sized and shaped to receive the boss; wherein when the visor is rotated, the sliding element travels along the outer surface through a plurality of positions; and wherein, in a first position in the plurality of positions, the boss is received within a first detent of the plurality of detents such that the visor magnetic element is disposed at the first detent base in proximity to the first detent magnetic element, resulting in an attractive force between the visor magnetic element and the first detent magnetic element effective to lock the visor in the first position.

In an embodiment of the helmet, the visor comprises at least one visor stop and the helmet comprises at least one helmet stop, the visor stop and the helmet stop cooperating to inhibit the visor from being lowered from the first position.

In another embodiment of the helmet, the first detent is a bottommost detent of the plurality of detents.

In another embodiment of the helmet, the first detent is disposed on the outer shell such that when the visor is in the first position, the shading element shades the eyes of a person wearing the helmet at a first shading angle.

In another embodiment of the helmet, the plurality of detents comprises at least two detents.

In another embodiment of the helmet, in a second position in the plurality of positions, the boss is received within a second detent of the plurality of detents such that the visor magnetic element is disposed at the second detent base in proximity to the second detent magnetic element, resulting in an attractive three between the visor magnetic element and the second detent magnetic element effective to lock the visor in the second position.

In another embodiment of the helmet, the second detent is disposed higher on the convex outer surface than the first position.

In another embodiment of the helmet, the second detent is disposed on the outer shell such that when the visor is in the second position, the shading element shades the eyes of a person wearing the helmet at a second shading angle In another embodiment of the helmet, plurality of detents comprises at least three detents.

In another embodiment of the helmet, in a third position in the plurality of positions, the boss is received within a third detent of the plurality of detents such that the visor magnetic element is disposed at the third detent base in proximity to the third detent magnetic element, resulting in an attractive force between the visor magnetic element and the third detent magnetic element effective to lock the visor in the third position.

In another embodiment of the helmet, the third detent is disposed on the outer shell such that when the visor is in the third position, the shading element shades the eyes of a person wearing the helmet at a third shading angle.

In another embodiment of the helmet, the visor, when rotated, can travel along the outer surface to a stowing position in the plurality positions such that an amount of surface area of the outer shell between a bottom of the visor and a front bottom of the helmet can receive stowed eyewear.

In another embodiment of the helmet, when the visor is in the stowing position, the boss is disposed posterior of a topmost detent of the plurality of detents.

In another embodiment of the helmet, when the visor is in the stowing position, the boss is disposed a topmost detent of the plurality of detents.

In another embodiment of the helmet, each detent in the plurality of detents has a sloped top flank and an opposing sloped bottom flank.

In another embodiment of the helmet, the sliding element is connected to the shading element via an extension element.

In another embodiment of the helmet, the sliding element is connected to extension element at a top end of the sliding element and the boss is disposed at a bottom end of the sliding element opposing the top end.

In another embodiment of the helmet, the visor magnetic element comprises a neodymium magnet and each of the detent magnetic elements comprise a metal plate made from iron.

In another embodiment of the helmet, the visor magnetic element comprises a metal plate made from iron, and each of the detent magnetic elements comprise a neodymium magnet.

DESCRIPTION OF THE PREFERRED EMBODIMENT(S)

The following detailed description and disclosure illustrates by way of example and not by way of limitation. This description will enable one skilled in the art to make and use the disclosed systems and methods, and describes several embodiments, adaptations, variations, alternatives and uses of the disclosed systems and methods. As various changes could be made without departing from the scope of the disclosures, it is intended that all matter contained in the description or shown in the accompanying Figures shall be interpreted as illustrative and not limiting.

Described herein, among other things, is a bicycle helmet having a multi-positional visor system in which the visor can be safely repositioned from one of a plurality of positions to a second of a plurality of positions by the cyclist during a ride. Cooperating structures in the visor and helmet inhibit unwanted changes in the visor position. At a high level of generality, the helmet has a magnet disposed in a protruding sliding element attached to the visor, which mates with one of a series of ferric elements disposed at positions in the helmet shell to hold the visor in place. The magnetic force inhibits the visor from being unintentionally dislodged. This is further enhanced by the use of a protrusion containing the magnet. The ferric elements may be disposed at the base of detents, which have a shape conforming to that of the magnet protrusion, further inhibiting unintentional repositioning. The visor may be inhibited from being moved it to a position that interferes with the cyclist's field of vision by a second locking system comprising two corresponding protrusions on the interior of the visor and the exterior of the helmet. These other features are described in more detail herein.

Figure 1:
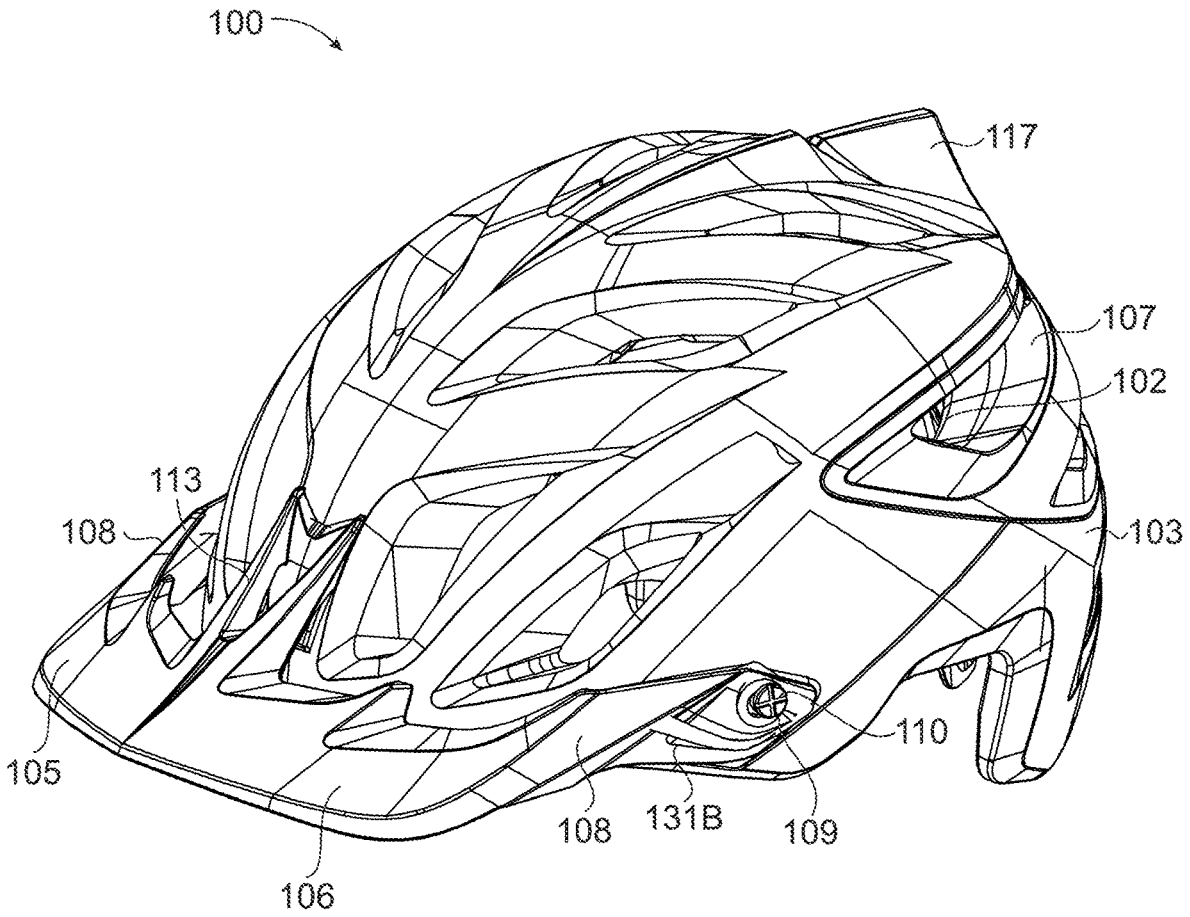
FIG. 1 depicts an embodiment a an assembled helmet and visor as described herein.
Figure 4:
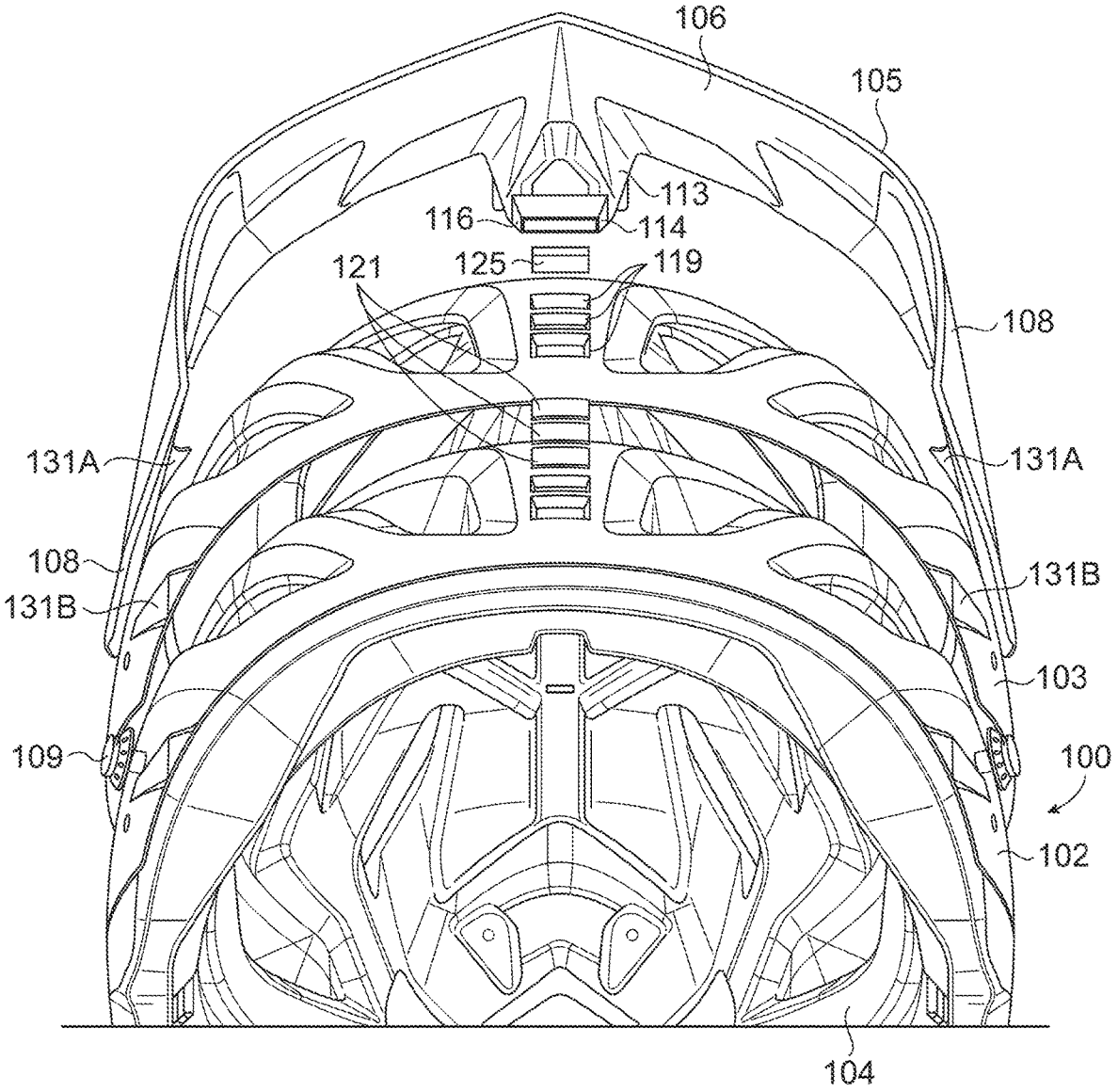
FIG. 4 depicts a bottom exploded view of an embodiment of a helmet and visor as described herein.

FIGS. 1 and 4 depict an exemplary embodiment of a bicycle helmet (100) according to the present disclosure. The depicted helmet (100) is shown from an isometric view, and comprises an outer shell (103), a corresponding inner shell (102), and a comfort liner (104). The outer shell (103) is preferably constructed from a material of sufficient structural rigidity to resist deformation or punctures during an impact, such as a polycarbonate. The outer shell (103) may also be able to experience mild deformation during impact to provide additional energy absorption. However, the inner shell (102) has the primary function of energy absorption. Accordingly, the outer shell (103) may be relatively thin as compared to the inner shell (102). A bicycle helmet typically has a generally convex outer shell, but the particular configuration may vary from embodiment to embodiment, and may include flat surfaces or elements.

The depicted inner shell (102), sometimes also referred to in the art as an impact liner (102), is disposed within the outer shell (103), and the majority of the energy absorption function of the helmet (100). The inner shell (102) is typically constructed from one or more impact-absorbing materials, such as foams like polystyrene. In an embodiment, other structures may also, or alternatively, be used, such as honeycomb structures and columns. The primary function of the inner shell (102) is to absorb a portion of the energy imparted to the helmet (100) during an impact, and convert that energy to heat. This also has the effect of reducing the rate of deceleration of the cyclist's head, which in turn reduces the incidence and severity of brain trauma.

Generally, a bicycle helmet (100) also has a comfort or ergonomic liner (104), such as that shown in FIG. 4, disposed within the inner shell (102). The comfort liner (104) is generally adapted to comfortably surround and cushion the human head, and provides a breathable, ergonomic interface between the head of the cyclist and the helmet (100). These comfort liners (104) are generally made from a Fabric or fabric like material, often with additional padding, to accommodate a variety of head shapes, hairstyles, and personal preferences. The comfort liner (104) may provide additional energy absorption properties.

As can also be seen in the exemplary embodiment of FIG. 1, the depicted helmet (100) comprises a plurality of openings (107) disposed at various locations on the outer surface of the outer shell (103). These openings (107) pass through the outer shell (103) and the inner shell (102), and through or around the comfort liner (104) to provide a direct pathway for air to reach the cyclist. These openings (107) are generally sized, shaped, dimensioned, and positioned on the helmet to maximize airflow to the cyclist, while also minimizing the open surface area, and thus reducing the likelihood of an object passing through the openings (107) and impacting the cyclist. One exemplary embodiment of an arrangement of such openings (107) is depicted in FIG. 1. In alternative embodiments, other arrangements are possible while remaining within the scope and spirit of the present disclosure.

Also depicted in the exemplary embodiment of FIG. 1 is a visor (105). The depicted visor (105) is attached to the helmet and disposed at the bottom front of the outer shell (103). The visor (105) comprises a shading element (106), shown in the depicted embodiment as a flat, wide brim (106)

extending across the front width of the helmet (100). Other configurations and shapes of shading elements (106) are possible and may be used in other embodiments.

Disposed at each of the opposing lateral sides of the shading element (106) are connecting arms (108) extending along the sides of the helmet towards the back, and each connecting arm (108) is attached to the outer shell (103) at a rotation point (109) disposed at the distal end of the connecting arm (108). The rotation points (109) are preferably collinear with each other. The cyclist may reach up and adjust the position of the visor (105) by rotating the visor (105) at the rotating points (109). In the depicted embodiment, the rotation points (109) comprise a rotatable fastener (110), such as a screw or bolt, but other rotatable connections are possible within the scope and spirit of this disclosure.

Figure 2:
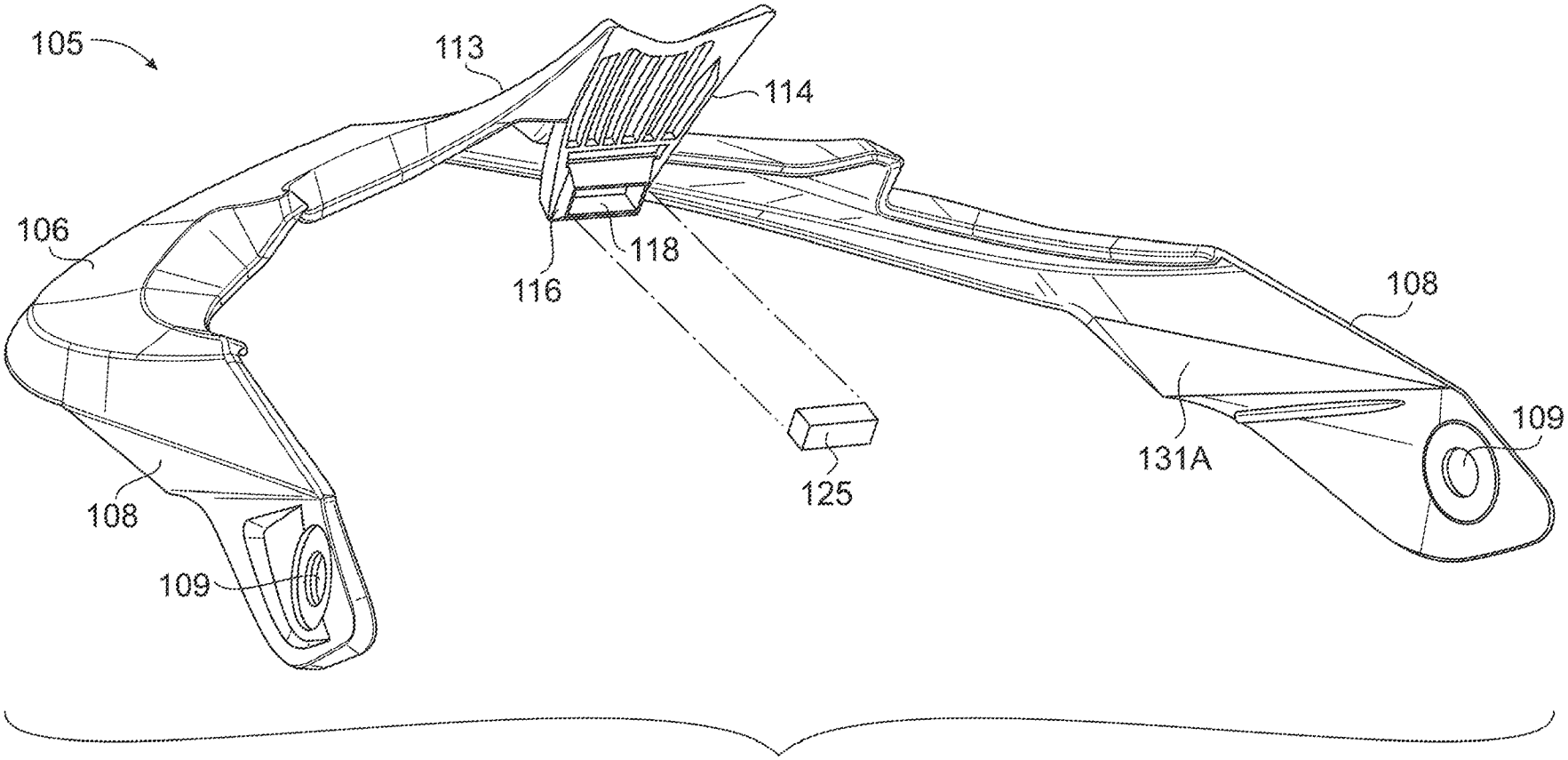
FIG. 2 depicts a reverse angle view of an embodiment of a visor as described herein.

A reverse-angle view off visor (105) and helmet (100) is shown in FIG. 2. These elements can also be seen in FIGS. 3 and 4. In the depicted embodiment of FIG. 2, the visor (105) comprises a sliding element (114) attached to the shading element (106) via an attaching element (113). The depicted sliding element (114) is generally in the configuration of an annular segment in which the inner surface (112A) has an arcuate cross-section that conforms to the cross-sectional curve (112B) of the medial anterior portion of the outer shell (103), as shown in the exemplary embodiment of FIG. 3.

As described elsewhere herein, this area of the outer shell is where the detente are disposed. When the visor (103) is attached to the helmet (100) at the rotation points (109), the dimensions and configuration of the extension element (113) are effective to cause the inner surface (112A) of the sliding element (114) to contact the medial anterior outer surface (112B) of the outer shell (103). When the visor (105) is rotated at the station points (109), the inner surface (112A) of the sliding element (114) travels up and down along the medial anterior surface to a plurality of positions along the curve (112B). As can be seen in the Figures, the visor (105) may further comprise other elements, extensions, and shapes, which may provide aerodynamic and/or aesthetic functions.

The shape of the cross-section will generally matches the contour of the portion of the helmet that the sliding element will travel along when the visor is rotated. Thus, in embodiments where the helmet has different shapes or contours, the shape of the sliding element may likewise differ from the Figures to match, including, but not limited to shapes or contours that are substantially or partially flat, convex, or concave as well as shapes or contours that insert into indentations within the contour of the helmet itself.

Figure 3:
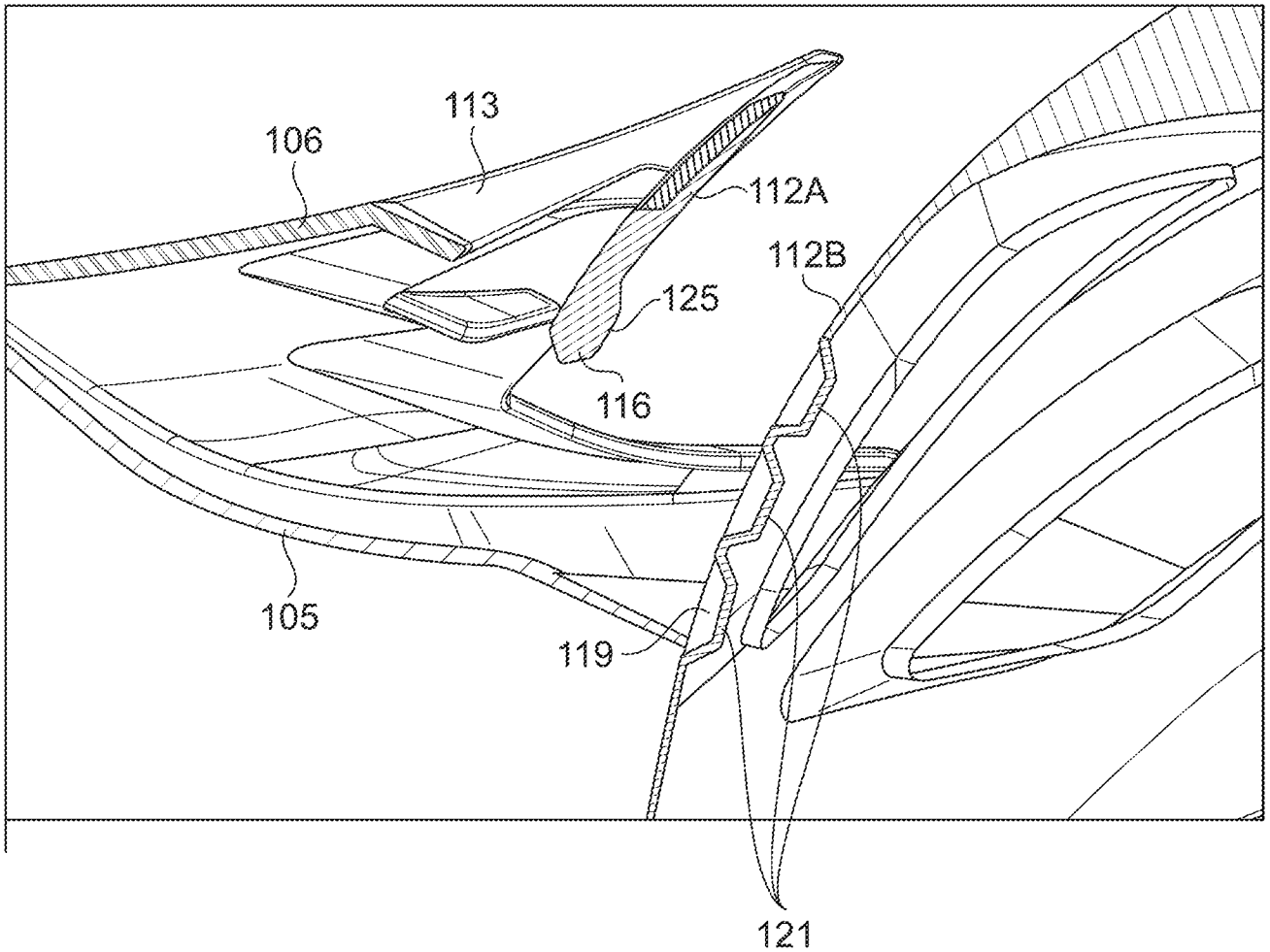
FIG. 3 depicts a medial cross-sectional exploded view of an embodiment of a helmet and visor as described herein.

As shown in the depicted embodiments of FIGS. 2, 3, and 4, the visor (105) may be "locked" into various positions by the interaction of sets of magnetic elements, meaning elements with mutually attractive magnetic properties, such as a pair of magnetic sources, or a magnetic source and a ferromagnetic element. At least one such element is generally disposed in the sliding element(s), and at least one such corresponding magnetic element is generally disposed with the helmet structure. In the depicted embodiments, a magnetic source or magnetic is disposed on the sliding element and a corresponding magnetic material, such a steel plate containing In the depicted embodiment, the sliding element (114) comprises a magnetic source (125). The magnetic source (125) may be any source that produces a magnetic field of adequate strength to provide the locking or holding functions described herein while also meeting other requirements for the helmet, such as weight limitations and fitting within the form factor of the visor (105). By way of example and not limitation, the magnetic source may be a magnetic material, such as a neodymium magnet.

The depicted helmet (100) further comprises at least one, and preferably a plurality of, ferromagnetic elements (121) disposed within the helmet (100) structure. In the depicted embodiments, the ferromagnetic elements (121) are disposed within the outer shell (103) and/or inner shell (102), or between the outer shell (103) and inner shell (102). The ferromagnetic elements (121) may be submerged beneath or within the outer shell (103) material, or directly exposed to the atmosphere.

When the visor (105) is attached to the helmet (100), the magnetic source (125) is disposed adjacent to and preferably in contact with the outer shell (103), and the ferromagnetic element (121) receives the magnetic field generated by the magnetic source (125). This results in an attractive force that establishes a "hold" or "lock" of the visor (105) in position. These terms, used with reference to magnetism, will be understood by a person of ordinary skill in the art in the context of this disclosure as meaning an attractive force or interaction between sets of magnetic elements, meaning elements with mutually attractive magnetic properties (such as, for example, a pair of magnetic sources, or a magnetic source and a ferromagnetic element) effective to prevent unintended repositioning of the visor (105) in response to forces ordinarily experienced during bicycling, including off-road and mountain bicycling. The specific strength of this "lock" or "hold" may vary from embodiment to embodiment depending on the riding environment in which the helmet (100) will be used.

The ferromagnetic elements (121) may be any material that exhibits ferromagnetic properties, such as, but not necessarily limited to iron, nickel, and other transition metals, and rare earth alloys, or materials that are made from or include such materials, such as ferromagnetic steel. The particular size, shape, and composition of the ferromagnetic elements may vary from embodiment to embodiment, and will generally be chosen in concert with the size, shape, and composition of the magnetic source (125) to achieve the desired level of magnetic hold or lock when the magnetic source (125) is disposed adjacent a ferromagnetic element (121).

In the preferred embodiment, a plurality of ferromagnetic elements (121) are included, and are preferably located in a series along the medial anterior of the helmet (100). This facilitates the magnetic source (125) locking with one such ferromagnetic element (121) at a tune, and thereby locking the visor into specific, predetermined positions along the center front of the helmet (100), each such position determined by the position of each ferromagnetic element (121). These positions may be selected based on any number of criteria, such as different levels of shading desired, or to allow the visor (105) to be moved high enough on the helmet to allow room to stow other equipment, notably eyewear, as further described elsewhere herein.

To augment magnetic locking at various positions, the sliding element (114) may further comprise a boss (116) disposed on the inner surface (112A). The depicted boss (116) is sized and shaped to fit a series of corresponding detents (119) along the medial anterior curve (112B) of the outer shell (103). The depicted boss (116) comprises a recess (118) or pocket (118) sized and shaped to accept the magnetic source (125), which may be held in place using any number of means, such as adhesives or pressfitting.

The depicted ferromagnetic elements (121) are submerged beneath the base of the detents (119). When the visor (105) is attached to the helmet (100) and rotated through a plurality of positions, in certain positions, the boss (116) is received within one of the plurality of detents (119). In these positions, the magnetic source (125) is disposed at the base of the detent (119), and establishes a magnetic lock with the corresponding ferromagnetic element (121). This magnetic lock, combined with the fit of the protruding boss (116) in the detent (119), inhibit or prevent unintentional dislocation of the visor (105) from each detent.

The size and shape of the boss (116) and detents (119) are generally selected to achieve a snug fit. This snug fit preferably leaves little space between the boss and detent walls, so as to prevent or inhibit small debris from settling in the detent and interfering with the fit or magnetic lock.

However, as can be seen in the Figures, when the cyclist relocates the visor (105), the boss (116) should slide out of the detent (119). This is assisted by the angled sides of the detents (119), the use of a deformable material in the construction of the sliding element (114) and/or extension element (113), and the shape and assembly of the sliding element (114) and/or extension element (113). In the depicted embodiment, the boss (116) is disposed at the bottom distal end of the sliding element (114), and the sliding element (114) is attached to the extension element (113) at the opposing top end. This facilitates flexing the arcuate body of the sliding element (114) outward from the helmet so the boss (116) may ride up and down the sloped sides of the detents (119) as it is moved. This facilitate sliding the boss (116) from one detent (119) to another (119) without the need to lift the boss (116) radially off the outer shell (103).

In the depicted embodiment, three detents (119) are shown with a corresponding set of three ferromagnetic elements (121), but in an alternative embodiment, a higher or lower number may be used. Likewise, and as described elsewhere in this disclosure, in an alternative embodiment, different positions for each detent (119)/ferromagnetic element (121) may be chosen depending on the design goals of the helmet (100).

The depicted detents (119) are all generally of the same size and shape, but in an alternative embodiment, one or more detents (119) may be configured differently. By way of example and not limitation, one or more detents (119) may be larger, to achieve a looser hold, or smaller to achieve a tighter hold. Likewise, the strength of magnetic bond between the magnetic source (125) and each ferromagnetic element (121) may be about the same for each ferromagnetic element (121), or may differ. Again, this may be done to achieve different degrees of hold strength for different positions.

In an embodiment, at least one detent (119) is disposed in a position effective for the visor (105) to shade the eyes of the rider, such as by reducing or inhibiting ambient glare from the sun during the day. This may be a bottommost or lowest position. In another embodiment, a plurality, or all, of the detents (119) is disposed on the helmet in positions effective to lock the visor (105) at a plurality of different elevations on the helmet, such that the shading element (106) can be positioned and adjusted to accommodate different cyclists, changes in cyclist posture over the course of a ride, or changes in the position of the sun over the course of a ride. In each different position, the shading element (106) may provide shading to the cyclist's eyes at a different angle, based on factors such as the elevation of the visor (105) on the helmet and the size, dimensions, and configuration of the shading element (106).

In the depicted embodiment, the visor (105) can be rotated upward and beyond the topmost detent (119), such that the boss (116) is not disposed in any detent. This positions the visor (105) in a stowing position sufficiently towards, or at, the top of the helmet so as to provide adequate storage for goggles or other eyewear on the bottom front of the helmet. This permits the cyclist to raise the visor (105) and temporarily move goggles worn by the rider to the helmet (101) brow. When the cyclist returns the goggles to the face, the visor (105) can then be easily lowered and locked into a detent (119) of the cyclist's choosing.

In an alternative embodiment, at least one detent (119) may be disposed in a position effective for stowage of eyewear, such as, but not limited to, glasses and/or riding goggles, on the anterior surface area of the helmet (100). That is, a detent (119) may be disposed in a position to lock the visor (105) in a raised position that allows sufficient room for riding goggles placed between the visor (105) and the bottom front of the helmet. This would typically be a topmost position, but in an alternative embodiment, there may be a plurality of different such positions to accommodate differing sizes and types of eyewear. In such embodiment, the topmost detent (119) may further comprise a top flank sized and shaped to inhibit further raising of the visor (105), such as vertical flank. Thus, if the cyclist attempts to further raise the visor (105), this may provide haptic feedback to the cyclist that the visor (105) is already in top position. In such an embodiment, the visor (105) can also be locked in a stowing position.

In an embodiment, the visor (105) and/or helmet (100) may further comprise structures for inhibiting the visor (105) from being rotated downward beyond a predefined position, such that the visor (105) would interfere with the cyclist's field of vision. This would both reduce the incidence of a dislodged visor (105) blocking the cyclist's view unexpectedly, and inhibit the cyclist from inadvertently lowering the visor (105) further than desired.

Although a single sliding element is depicted disposed at the center of the helmet, in an alternative embodiment, a visor (105) may have more than one sliding element, and/or the sliding elements(s) may disposed in different locations with corresponding detents. For example, a visor (105) could have two sliding elements disposed on opposing sides of the helmet centerline, with two sets of detents.

The depicted helmet (100) and visor (105) a pair of mating stops (131A) and (131B) disposed on each component to inhibit rotating the visor (105) downward beyond a predetermined position. In the depicted embodiment of FIGS. 2-4, one such stop (131A) is disposed on the interior side of the visor (105) near the distal end of the attaching arm (108). The depicted stop (131A) is a generally triangular protrusion extending inwardly towards the outer shell (103). A mating stop (131B) is disposed on a corresponding location on the outer shell (103). When the visor (105) is at its bottommost position, these two stops (131A) and (131B) are adjacent one another, and if pressure is applied to lower the visor (105) further, the visor stop (131A) contacts the helmet stop (131B) and inhibits further movement.

Generally, the size, shape, and positioning of the stops (131A) and (131B) are effective to firmly inhibit further downward rotation sufficiently to provide haptic feedback to the cyclist that the visor (105) is already in bottommost position and should not be lowered further. In the depicted embodiment, two pairs of stops may be disposed on each side of the visor (105) to further inhibit unwanted lowering. Although triangular stops (131A) and (131B) are shown, other shapes may be used.

The depicted helmet further depicts an aerodynamic fin (117) located at the top hack of the helmet, this feature comprises a pair of opposing flanking slopes rising to a linear crest that has a main axes along the central line of the outer shell (103). The aerodynamic properties of the shape are believed to provide additional airflow benefits to the cyclist for both overall aerodynamic performance and cooling.

Throughout this disclosure, geometric terms may be used to characterize, among other things, sizes, shapes, dimensions, angles, distances, and relationships. These terms may be used with qualifiers such as "generally," "about," and "approximately." One of ordinary skill in the art will understand that, in the context of this disclosure, these terms are used to describe a recognizable attempt to conform a device or component to the qualified term. By way of example and not limitation, components described as being "generally coplanar" will be recognized by one of ordinary skill m the art to not be actually coplanar in a strict geometric sense because a "plane" is purely geometric construct that does not actually exist and no component is truly "planer," nor are two components ever truly coplanar. Variations from geometric descriptions are unavoidable due to, among other things, manufacturing tolerances resulting in shape variations, defects, imperfections, non-uniform thermal expansion, natural wear, minor variations that are nevertheless recognizable as the qualified term, and other deformations. One of ordinary skill in the art will understand how to apply geometric terms, whether or not qualified by relative terms such as "generally," "about," and "approximately," to describe a reasonable range of variations from the literal geometric term in view of these and other considerations appropriate to the context. Additionally, the use of the conjunctive and disjunctive should not necessarily be construed as limiting, and the conjunctive may include the disjunctive, and vice versa.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A bicycle helmet comprising:

an outer shell defining an inner volume adapted to fit a human head, said outer shell comprising:

an outer surface;

a plurality of detents disposed along said outer surface at a front side thereof;

each detent in said plurality of detents having a magnetic element disposed at a base thereof;

a visor mechanically and rotatably fastened to said outer shell and comprising:

a shading element;

a sliding element comprising:

a cross-section having a surface contour corresponding to a surface contour of said outer surface at said plurality of detents;

a boss disposed on an inner surface of said sliding element, said boss having a recess;

a visor magnetic element disposed in said recess;

wherein said plurality of detents are sized and shaped to receive said boss;

wherein when said visor is rotated, said sliding element travels along said outer surface through a plurality of positions;

wherein, in a first position in said plurality of positions, said boss is received within a first detent of said plurality of detents such that said visor magnetic element is disposed at said first detent base in proximity to said first detent magnetic element, resulting in an attractive force between said visor magnetic element and said first detent magnetic element effective to lock said visor in said first position; and wherein said visor comprises at least one visor stop and said helmet comprises at least one helmet stop, said visor stop and said helmet stop cooperating to inhibit said visor from being lowered from said first position.

2. The bicycle helmet of claim 1, wherein said first detent is a bottommost detent of said plurality of detents.

3. The bicycle helmet of claim 1, wherein said first detent is disposed on said outer shell such that when said visor is in said first position and when said helmet is worn by a person, said shading element is in a position effective to shade the eyes of said person wearing said helmet at a first shading angle.

4. The bicycle helmet of claim 1, wherein said plurality of detents comprises at least two detents.

5. The bicycle helmet of claim 4, wherein, in a second position in said plurality of positions, said boss is received within a second detent of said plurality of detents such that said visor magnetic element is disposed at said second detent base in proximity to said second detent magnetic element, resulting in an attractive force between said visor magnetic element and said second detent magnetic element effective to lock said visor in said second position.

6. The bicycle helmet of claim 5, wherein said second detent is disposed above said first detent on a convex outer surface of the helmet.

7. The bicycle helmet of claim 6, wherein said second detent is disposed on said outer shell such that when said visor is in said second position and when said helmet is worn by a person, said shading element position effective to shade the eyes of said a person wearing said helmet at a second shading angle.

8. The bicycle helmet of claim 4, wherein plurality of detents comprises at least three detents.

9. The bicycle helmet of claim 8, wherein, in a third position in said plurality of positions, said boss is received within a third detent of said plurality of detents such that said visor magnetic element is disposed at a third detent base in proximity to a third detent magnetic element, resulting in an attractive force between said visor magnetic element and said third detent magnetic element effective to lock said visor in said third position.

10. The bicycle helmet of claim 9, wherein said third detent is disposed on said outer shell such that when said visor is in said third position and when said helmet is worn by a person, said shading element position is effective to shade the eyes of said a person wearing said helmet at a third shading angle.

11. The bicycle helmet of claim 1, wherein the visor, when rotated, can travel along said outer surface to a stowing position in said plurality positions such that an amount of surface area of the outer shell between a bottom of the visor and a front bottom of said helmet can receive stowed eyewear.

12. The bicycle helmet of claim 11, wherein when said visor is in said stowing position, said boss is disposed posterior of a topmost detent of said plurality of detents.

13. The bicycle helmet of claim 11, wherein, when said visor is in said stowing position, said boss is disposed a topmost detent of said plurality of detents.

14. The bicycle helmet of claim 1, wherein each detent in said plurality of detents has a sloped top flank and an opposing sloped bottom flank.

15. The bicycle helmet of claim 1, wherein said sliding element is connected to said shading element via an extension element.

16. The bicycle helmet of claim 15, wherein said sliding element is connected to said extension element at a top end of said sliding element and said boss is disposed at a bottom end of said sliding element opposing said top end.

17. The bicycle helmet of claim 1, wherein said visor magnetic element comprises a neodymium magnet and each of said detent magnetic elements comprise a metal plate made from iron.

18. The bicycle helmet of claim 1, wherein said visor magnetic element comprises a metal plate made from iron, and each of said detent magnetic elements comprise a neodymium magnet.

19. The bicycle helmet of claim 1, wherein said visor is mechanically fastened to said helmet using a bolt or screw.

* * * * *